US005218941A

United States Patent [19]

Suzuki et al.

[11] Patent Number: 5,218,941

[45] Date of Patent: Jun. 15, 1993

[54] FUEL INJECTION CONTROL METHOD FOR AN INTERNAL COMBUSTION ENGINE

[75] Inventors: Kazuo Suzuki; Fusao Tachibana, both of Saitama, Japan

[73] Assignee: Fuji Jukogyo Kabushiki Kaisha, Tokyo, Japan

[21] Appl. No.: 926,154

[22] Filed: Aug. 5, 1992

[30] Foreign Application Priority Data

Sep. 6, 1991 [JP] Japan ..... 3-227373

[51] Int. Cl.[5] ..... F02D 41/04

[52] U.S. Cl. ..... 123/478; 123/463; 123/494

[58] Field of Search ..... 123/198 DB, 198 DC, 123/381, 387, 463, 478, 494

[56] References Cited

U.S. PATENT DOCUMENTS

| | | | |
|---|---|---|---|
| 4,800,859 | 1/1989 | Sagisaka et al. | 123/463 X |
| 4,955,345 | 9/1990 | Brown et al. | 123/381 |
| 4,967,712 | 11/1990 | Chasteen | 123/478 |
| 5,044,344 | 9/1991 | Tuckey et al. | 123/494 X |
| 5,050,559 | 9/1991 | Kurosu et al. | 123/478 |
| 5,090,386 | 2/1992 | Kurosu et al. | 123/478 |
| 5,114,115 | 5/1992 | Gillott | 123/198 DB |

FOREIGN PATENT DOCUMENTS

| | | |
|---|---|---|
| 1-224636 | 9/1989 | Japan . |
| 2-95747 | 4/1990 | Japan . |
| 2-108827 | 4/1990 | Japan . |
| 3-175121 | 7/1991 | Japan . |
| 3-175131 | 7/1991 | Japan . |

*Primary Examiner*—Willis R. Wolfe
*Attorney, Agent, or Firm*—Martin A. Farber

[57] ABSTRACT

A pressure sensor is provided in a fuel supply line for detecting fuel pressure for generating a pressure signal. The pressure signal is compared with a predetermined pressure value dependent on operating conditions of an engine. Amount of fuel injected into the engine is decreased when the pressure signal is higher than the predetermined pressure value, or the amount of fuel is increased when the pressure signal is lower than the predetermined pressure value for effectively preventing the engine from damaging.

4 Claims, 15 Drawing Sheets

FUEL INJECTION CONTROL METHOD FOR AN INTERNAL COMBUSTION ENGINE

BACKGROUND OF THE INVENTION

The present invention relates to a fuel injection control method for an internal combustion engine having an electronic control system such as a microcomputer.

The fuel injection control system having the microcomputer is widely used in various types of engines such as a four-cycle engine and a two-cycle engine.

Japanese Patent Application Laid-Open 2-108827 discloses such an electronic fuel injection control system for the two-cycle engine. In the system, operating frequency of a fuel injector is controlled based on crankcase inner pressure and engine speed, or throttle valve opening degree in dependency on the engine operating conditions.

An applicant of the present invention have proposed a fuel injection control system for the two-cycle engine disclosed in Japanese Patent Application Laid-Open 3-175121 and 3-175131. In the systems, fuel injection quantity is controlled in accordance with various engine operating conditions such as engine speed and throttle opening degree as parameters.

In the prior art, the fuel injection is controlled by the open-loop method. If the fuel pressure deviates out of a normal range in such an abnormal condition that the amount of fuel in the fuel tank is very small or a pressure regulator does not properly operate, the air-fuel mixture becomes extremely rich or extremely lean. However, the open-loop control system can not correct such an unusual air-fuel mixture. Furthermore, if the air-fuel mixture becomes extremely rich, the ignitability of the fuel reduces, which causes unstable combustion operation of the engine. In particular, in the two-cycle engine, combustion condition affects the temperature of the crankcase and cylinders. If a lean air-fuel mixture continues for a long time, the engine operation becomes unstable. Therefore, it is necessary to prevent the air-fuel mixture from becoming extremely lean.

Japanese Patent Application Laid-Open 2-95747 discloses a system for controlling the air-fuel ratio by feedback control. In the system, an $O_2$-sensor is provided in the exhaust pipe for detecting an extreme lean air-fuel mixture caused by percolation in a fuel injector at a high temperature of the engine and for detecting an extreme rich air-fuel mixture caused by high intake air temperature in order to control the air-fuel ratio.

If such a system is employed in the two-cycle engine, the air-fuel ratio is properly controlled in dependency on the engine operating conditions.

However, a time elapses before the air-fuel ratio is properly controlled because of control delay of the feedback control system. Therefore, undesirable engine operation continues for a while.

SUMMARY OF THE INVENTION

An object of the present invention is to provide a fuel injection control method which may quickly detect an abnormality of fuel pressure for controlling an air-fuel ratio, thereby ensuring a stable engine operation.

According to the present invention, there is provided a fuel injection control method for an internal combustion engine, having a crankshaft in a crankcase, a cylinder with a spark plug, a generator provided in the crankcase for generating power to the spark plug, an injector provided on an intake manifold for injecting an amount of fuel into the cylinder, a throttle sensor for detecting an opening degree of a throttle valve and for generating a degree signal, an atmospheric pressure sensor for sensing an atmospheric pressure, and a pressure sensor provided in a fuel supply line for detecting a fuel pressure and for generating a pressure signal.

The method comprises the steps of, comparing the pressure signal with a predetermined pressure value in accordance with operating conditions of the engine, decreasing the amount of fuel when the pressure signal is higher than the predetermined pressure value, and increasing the amount of fuel when the pressure signal is lower than the predetermined pressure value.

In an aspect of the invention, the engine is stopped either by cutting the power to the spark plug or by cutting the fuel when the pressure signal is lower than the predetermined pressure value.

The other objects and features of the present invention will become understood from the following description with reference to the accompanying drawings.

DETAILED DESCRIPTION OF THE PREFERRED EMBODIMENTS

Figure 1:
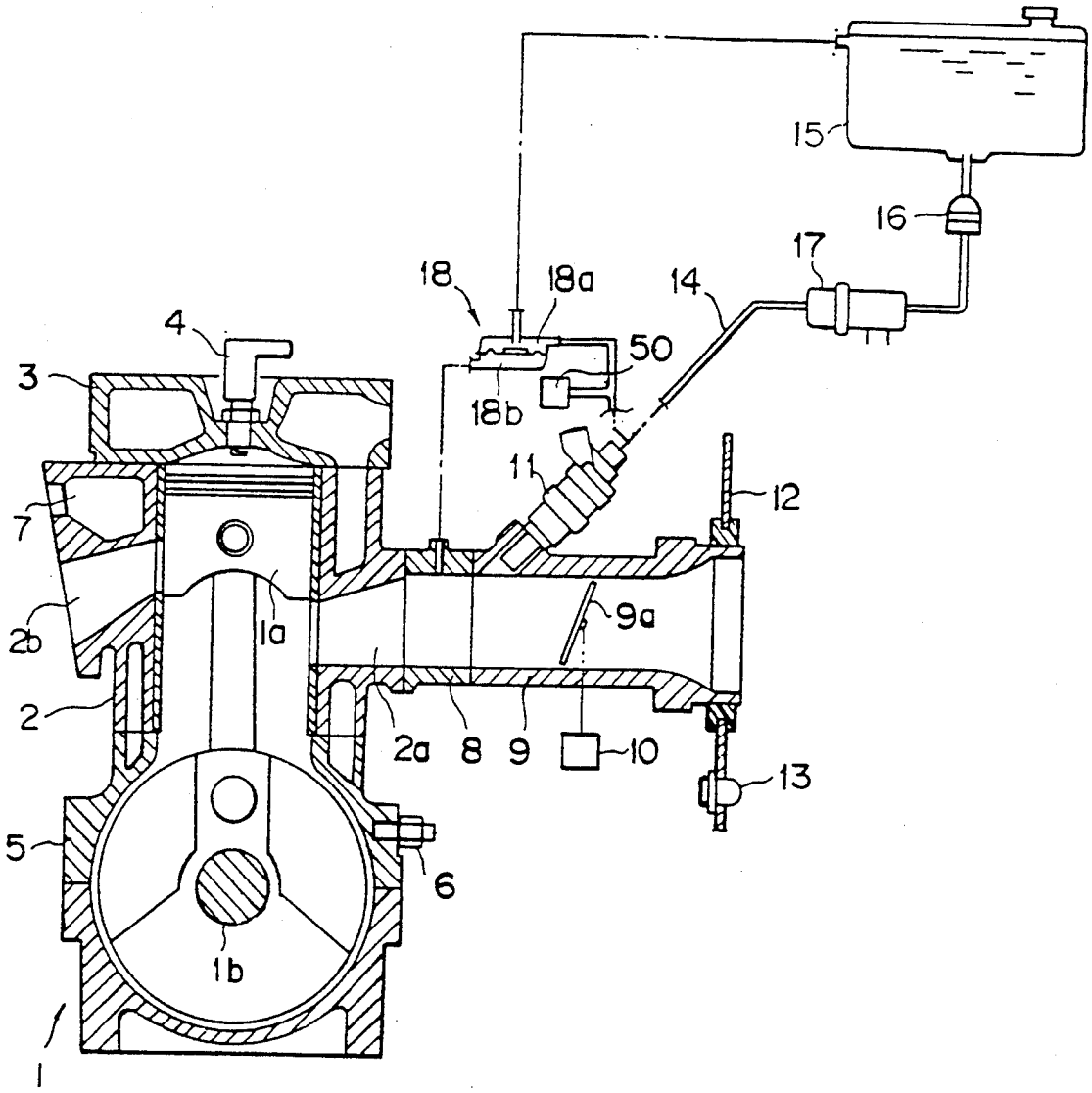
FIG. 1 is a schematic diagram showing an internal combustion engine of the present invention.

Referring to FIG. 1 showing a two-cycle three-cylinder engine 1 for a snowmobile, a cylinder 2 of the engine 1 has an intake port 2*a* and an exhaust port 2*b*. A piston 1*a* is provided in the cylinder 2 and a crankshaft 1*b* is disposed in a crankcase 5. A spark plug 4 is located in each combustion chamber of a cylinder head 3. A crankcase temperature sensor 6 is provided on the crankcase 5. Water jackets 7 are provided in the crankcase 5, the cylinder 2 and the cylinder head 3. The intake port 2*a* is communicated with an intake manifold 9 through an insulator 8. A throttle valve 9*a* is provided in the intake manifold 9. A throttle position sensor 10 is attached to the intake manifold 9. A fuel injector 11 is provided in the intake manifold 9 adjacent the intake port 2*a*. The intake manifold 9 is communicated with an air box 12 having an air cleaner (not shown). An intake air temperature sensor 13 is mounted on the air box 12.

Fuel in a fuel tank 15 is supplied to the injector 11 through a fuel passage 14 having a filter 16 and a fuel pump 17.

The fuel injector 11 is communicated with a fuel chamber 18*a* of a pressure regulator 18 and the fuel tank 15 is communicated with an outlet of the fuel chamber 18*a*. A fuel pressure sensor 50 is provided in the passage between the fuel injector 11 and the fuel chamber 18*a* for detecting a fuel pressure. A pressure regulating chamber 18*b* is communicated with the intake manifold 9.

The fuel in the tank 15 is supplied to the fuel injector 11 and the pressure regulator 18 by the pump 17 through the filter 16. The difference between the inner pressure of the intake manifold 9 and the fuel pressure applied to the injector 11 is maintained at a predetermined value by the pressure regulator 18 so as to prevent the fuel injection quantity of the injector 11 from changing.

Figure 2A:
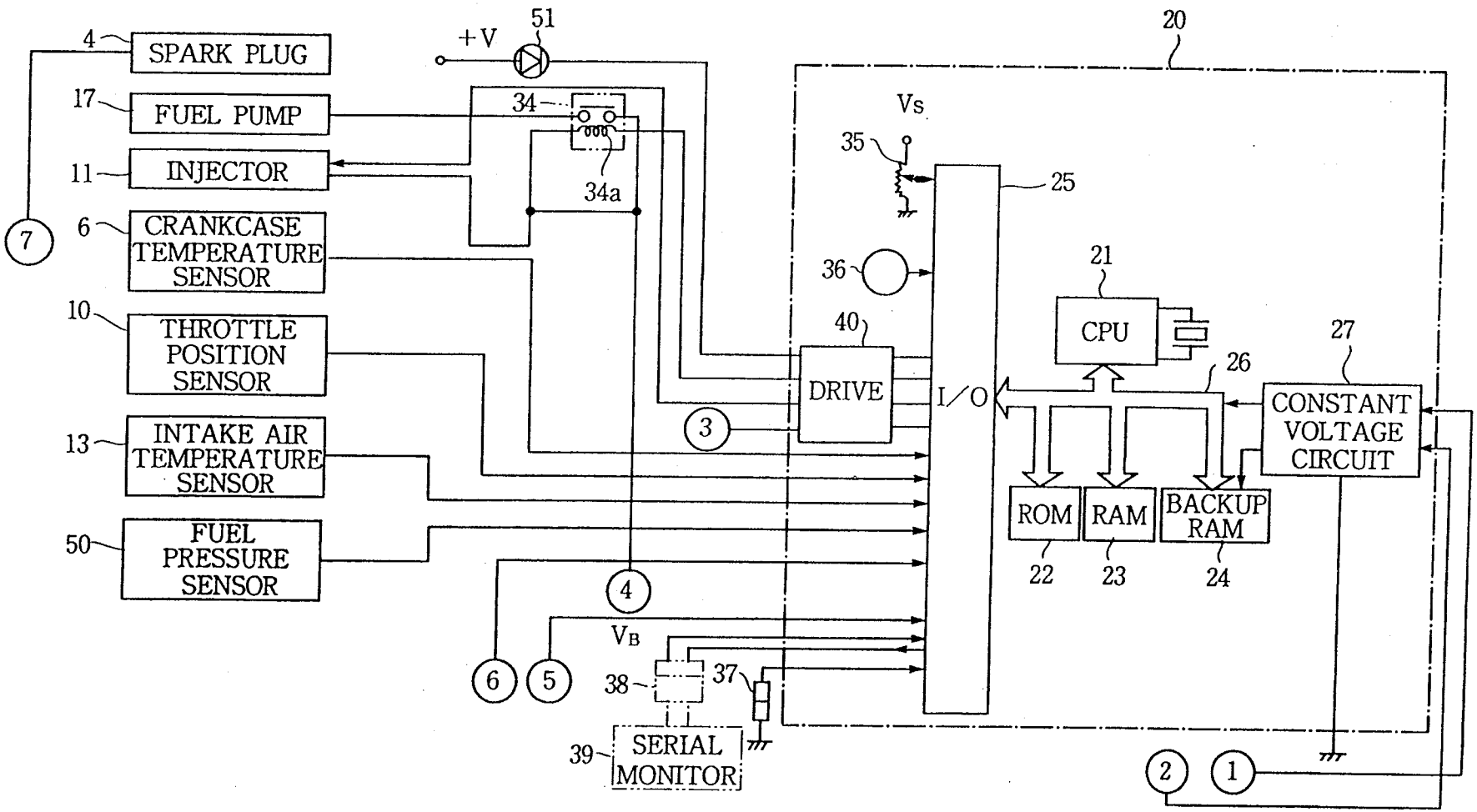
FIGS. 2*a* and 2*b* are a diagram showing a control system for the engine.
Figure 2B:
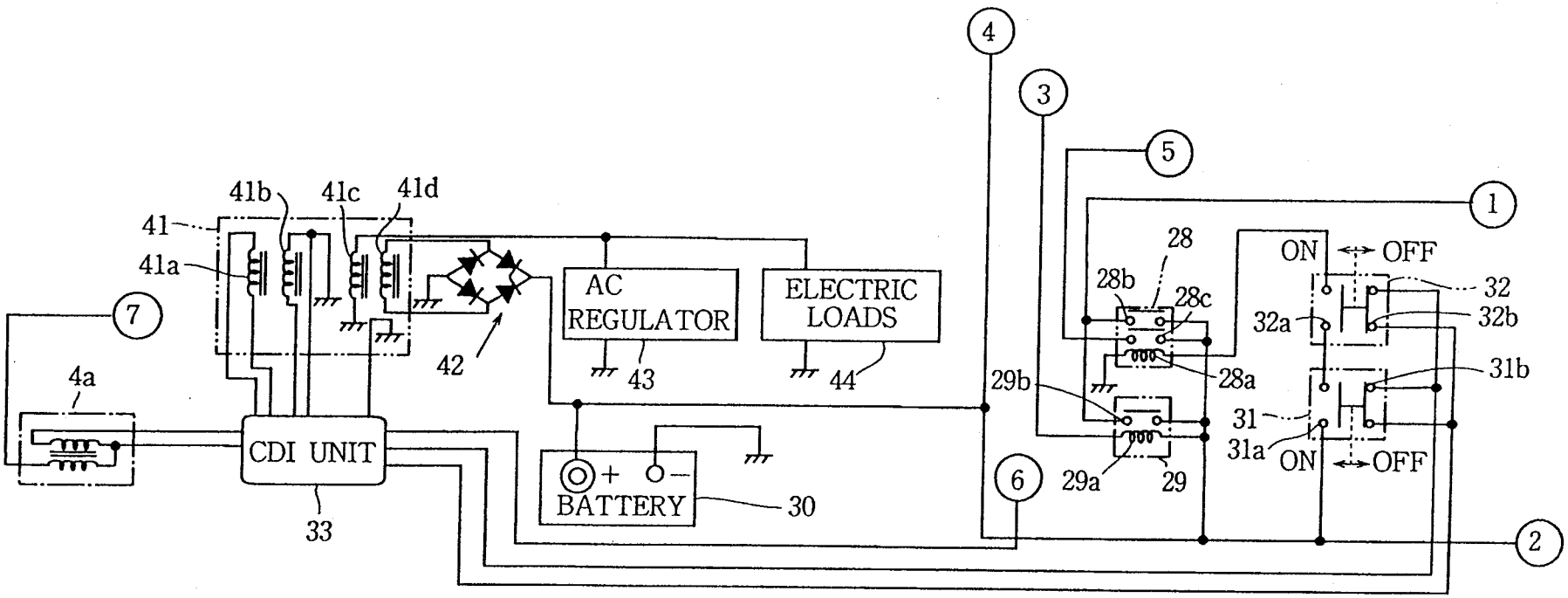

Referring to FIGS. 2*a* and 2*b*, an electronic control unit (ECU) 20 having a microcomputer comprises a CPU (central processing unit) 21, a ROM 22, a RAM 23, a backup RAM 24 and an input/output interface 25, which are connected to each other through a bus line 26. A predetermined voltage is supplied from a constant voltage circuit 27. The constant voltage circuit 27 is connected to a battery 30 through a contact 28*b* of an ECU relay 28 and a contact 29*b* of a self-shut relay 29 which are parallelly connected with each other. Furthermore, the battery 30 is directly connected to the constant voltage circuit 27 so that the backup RAM 24 is backed up by the battery 30 so as to maintain the stored data even if a key switch (not shown) is in off-state.

Sensors 6, 10, 13 and 50 are connected to input ports of the input/output interface 25. An atmospheric pressure sensor 36 is provided in the control unit 20 and connected to an input port of the input/output interface 25. Further, an MR resistor 35 is connected to a standard voltage VS to apply a divided voltage to the input port of the I/O interface 25. The MR resistor 35 is provided for adjusting the idle speed of the engine. When the engine 1 is idling, the CPU 21 of the control unit 20 reads the adjusting voltage from the MR resistor 35 to calculate the pulse width corresponding to the adjusting voltage. The pulse width is added to or subtracted from the basic fuel injection pulse width, so that the idle speed of the engine 1 is adjusted. Output ports of the interface 25 are connected to a driver 40 which is connected to injectors 11, a coil 34*a* of a relay 34 for the pump 17, and an ECS lamp 51 for indicating an abnormality.

The ECU relay 28 has a pair of contacts 28*b* and 28*c* and an electromagnetic coil 28*a*. As hereinbefore described, the contact 28*b* is connected to the constant voltage circuit 27 and the battery 30. The other contact 28*c* is connected to the input port of the I/O interface 25 and the battery 30 for monitoring the voltage VB of the battery 30. The coil 28*a* of the relay 28 is connected to the battery 30 through ON-contacts 32*a*, 31*a* of a kill switch 32 and an ignition switch 31.

The kill switch 32 is provided on a grip (not shown) of the snowmobile to stop the engine.

ON-contacts 31*a* and 32*a* of the ignition switch 31 and the kill switch 32 are connected to each other in series and OFF-contacts 31*b* and 32*b* of the switches 31 and 32 are connected to each other in parallel. Both the switches 31 and 32 are connected each other in parallel. When both the switches 31 and 32 are turned on, power from the battery 30 is supplied to the coil 28*a* of the relay 28 to excite the coil to close each contact. Thus, the power from the battery 30 is supplied to the constant voltage circuit 27 through the contact 28*b* for controlling the control unit 20.

The self-shut relay 29 has the contact 29*b* connected to the constant voltage circuit 27 and the battery 30 and a coil 29*a* connected to the output port of the I/O interface 25 through the driver 40 and the battery 30.

When one of the switches 31 and 32 is turned off, the engine stops. After the engine 1 stops, the power from the battery 30 is supplied to the coil 29*a* of the self-shut relay 29 for a predetermined period (for example, ten minutes) by the operation of the control unit, thereby supplying the power to the control unit 20 for the period.

When the engine 1 is restarted while the engine 1 is warm within the period, the quantity of the fuel injected from the injector 11 is corrected to a proper value, so that the restart of the engine 1 in hot engine condition is ensured.

The battery 30 is further connected to the coil 34*a* of the fuel pump relay 34 and the injector 11, and to the pump 17 through a contact of the relay 34.

As a self-diagnosis function of the system, a connector 37 for changing a diagnosis mode and a connector 38 for diagnosing the engine 1 are connected to the input ports of the I/O interface 25. A serial monitor 39 is connected to the control unit 20 through the connector 38. The trouble mode changing connector 37 operates to change the self-diagnosis function of the control unit 20 into either a U(user)-check mode or D(dealer)-check mode. In normal state, the connector 37 is set in the U-check mode. When an abnormality occurs in the system during the driving of the vehicle, trouble data are stored and kept in the backup RAM 24. At a dealer's shop, the serial monitor 39 is connected through the connector 38 to read the data stored in the RAM 24 for diagnosing the trouble of the system. The connector 37 is changed to the D-check mode to diagnose the trouble more in detail. The detailed description of the serial monitor 39 is disclosed in Japanese Patent Application Laid-Open 1-224636 proposed by the applicant of the present invention.

Furthermore, a CDI unit 33 is provided as an ignition device. The CDI unit 33 is connected to a primary coil of an ignition coil 4*a* and to the spark plug 4 through a secondary coil. A signal line of the CDI unit 33 is connected to the input port of the I/O interface 25 of the control unit 20 for applying CDI pulses. When one of the switches 31 and 32 is turned off, lines for the CDI unit are short-circuited to stop the ignition operation.

A generator 41 for generating alternating current is connected to the crankshaft 1*b* of the engine 1 to be operated by the engine. The generator 41 has an exciter coil 41*a*, a pulser coil 41*b*, a lamp coil 41*c*, and a charge coil 41*d*. The exciter coil 41*a* and pulser coil 41*b* are connected to the CDI unit 33. The lamp coil 41*c* is connected to an AC regulator 43, so that the voltage is regulated, and the regulated voltage is applied to an electric load 44 such as lamps, a heater and various accessories of the vehicle. Namely, the regulated output of the generator is independently supplied to the electric load 44. The charge coil 41*d* is connected to the battery 30 through a rectifier 42.

Figure 3A:
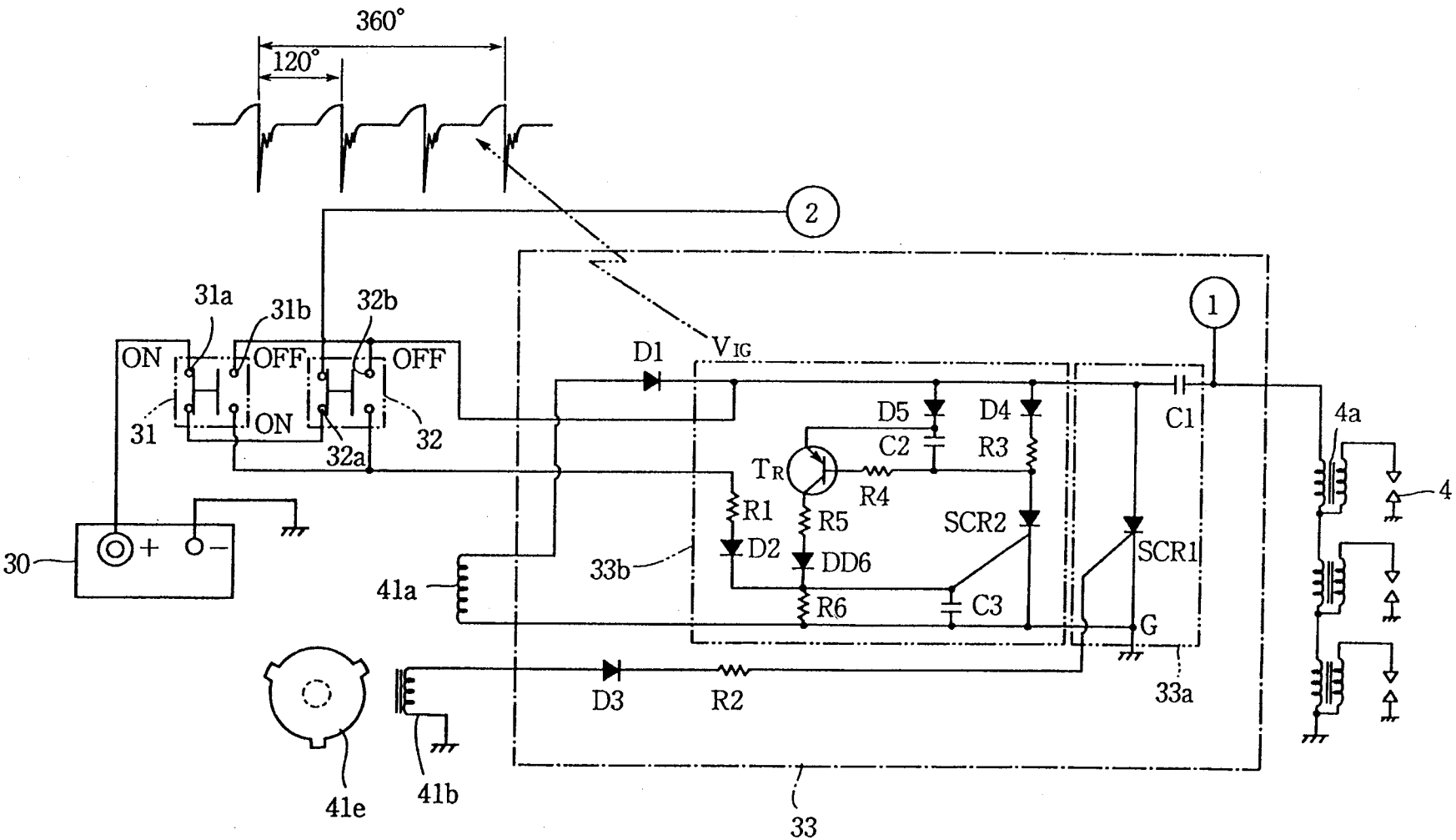
FIGS. 3*a* and 3*b* are a circuit showing a CDI unit provided in the control system.
Figure 3B:
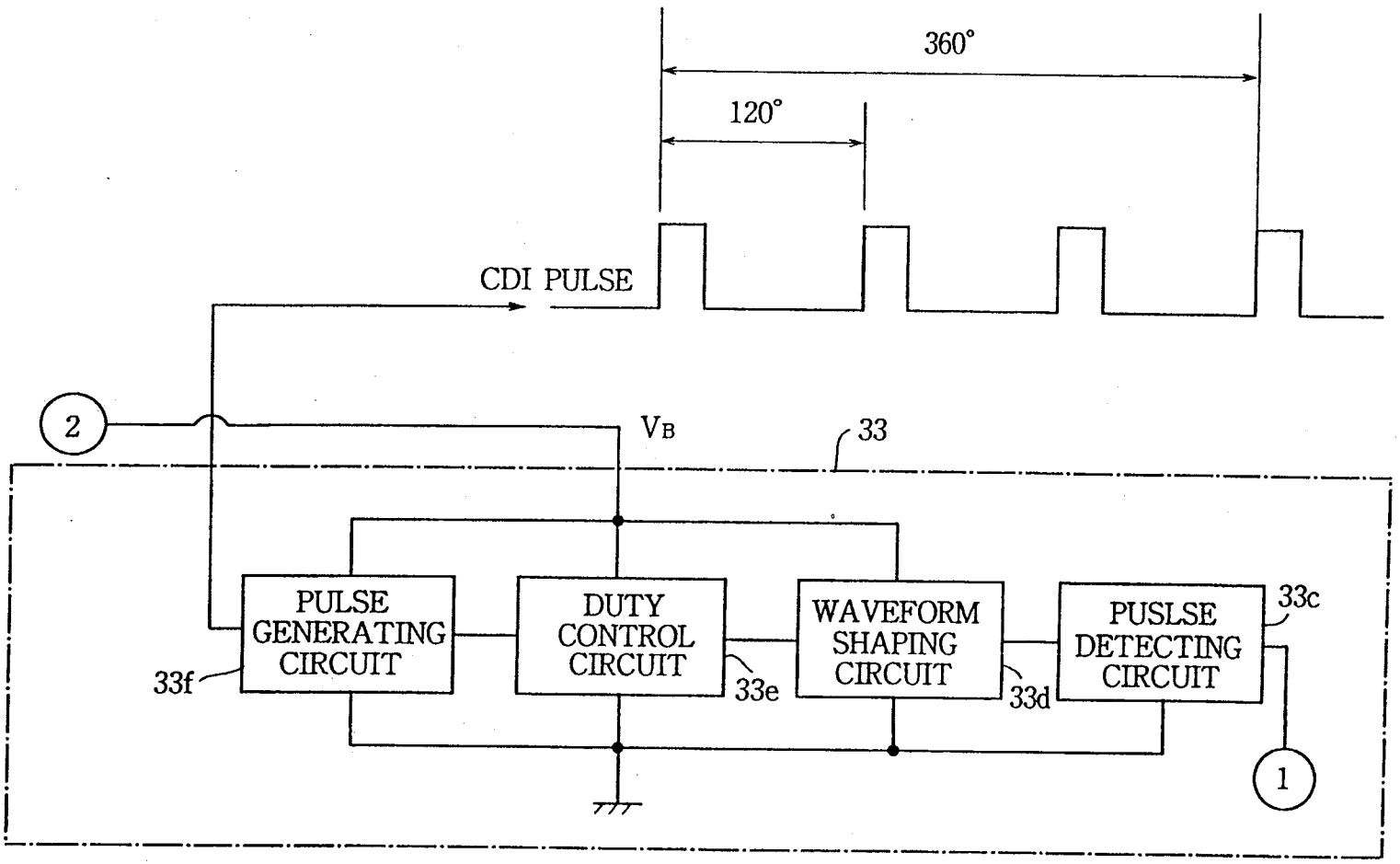

Referring to FIGS. 3*a* and 3*b* showing the CDI unit 33, the exciter coil 41*a* is connected to an ignition source VIG of an ignition source short-circuiting circuit 33*b* through a diode D1. The ignition source short-circuiting circuit 33*b* has a first diode D4 and a second diode D5 anodes of which are connected to the source VIG. Cathodes of the diodes D4 and D5 are connected to an anode of a thyristor SCR2 through a resister R3 and a capacitor C2, respectively. A cathode of the thyristor SCR2 is connected to the ground G. The cathode of the second diode D5 is further connected to an emitter of a PNP transistor TR. A base of the transistor TR is connected to the anode of the thyristor SCR2 through a resister R4. A collector of the transistor TR is connected to a gate of the thyristor SCR2 through a resister R5 and a diode D6. A resister R6 and a capacitor C3 are connected between the gate of the thyristor SCR2 and the ground G in parallel to each other for preventing noises and commutation caused by an increasing rate of critical off voltage.

OFF-contacts of the ignition switch 31 and the kill switch 32 are connected to the source VIG and to the gate of the thyristor SCR2 through a resister R1 and a diode D2.

An ignition circuit 33*a* is a well-known capacitor discharge ignition circuit and comprises a capacitor C1 and a thyristor SCR1 to which the source VIG is connected. The pulser coil 41*b* is connected to a gate of the thyristor SCR1 through a diode D3 and a resister R2. The pulsar coil 41*b* is provided adjacent a crank angle sensor disk 41*e* of the magneto 41.

Figure 4:
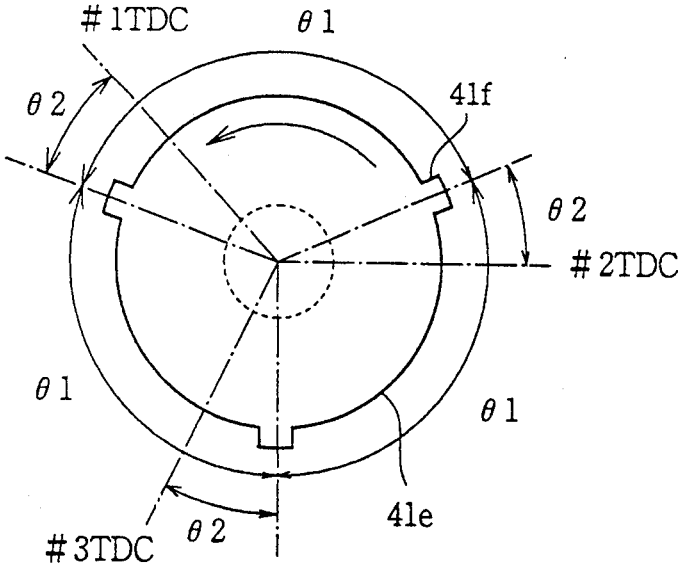
FIG. 4 is a front view showing a crank angle disk in the CDI unit.

Referring to FIG. 4, the crank angle sensor disk 41*e* has three projections (notches) 41*f* formed on an outer periphery thereof at equal intervals Θ1 (120 degrees). The projections 41*f* represent the before top dead center (BTDC) Θ2 (for example 15 to 20 degrees) of No.1 to No.3 cylinders. When the disk 41*e* is rotated, the pulsar coil 41*b* detects the positions of the projections 41*f* in accordance with electromagnetic induction and produces an ignition trigger signal in the form of a pulse.

The trigger signal is applied to the thyristor SCR1 at a predetermined timing. The thyristor SCR1 is connected to the ground G. The capacitor C1 is connected to the primary coils 4*a* of the spark plugs 4 and to a pulse detecting circuit 33*c*.

The CDI unit 33 further comprises a waveform shaping circuit 33*d*, a duty control circuit 33*e* and a pulse generating circuit 33*f* which are connected to the battery 30 through ON-contacts of the kill switch 32 and the ignition switch 31. The pulse generating circuit 33*f* produces CDI pulse signals (FIG. 3) in synchronism with the source VIG. The CDI pulse signals are applied to the I/O interface 25 of the control unit 20 as hereinbefore described.

In the present invention, the pulsar coil 41*b* produces an ignition trigger signal at every crank angle 120° to ignite the three cylinders at the same time. The pulse generating circuit 33*f* produces a CDI pulse signal at every crank angle 120° to inject the fuel from the fuel injectors 11 in the three cylinders at the same time.

Describing the operation, when the engine starts, an alternating voltage generated in the exciter coil 41*a* is rectified by the diode D1 and applied to the capacitor C1 in the ignition circuit 33*a* to charge the capacitor.

The pulsar coil 41*b* produces a reference signal voltage at a predetermined crank position and the voltage is applied to the gate of the thyristor SCR1 through the diode D3 and the resister R2.

When the voltage reaches at trigger level of the thyristor SCR1, the thyristor SCR1 becomes conductive so that the load charged in the capacitor C1 is discharged to a closed circuit comprising the capacitor C1, the thyristor SCR1, primary coils of the ignition coils 4*a*, and the capacitor C1. Thus, high voltage of an extremely large positive going is produced in the secondary coils of the ignition coils 4*a* to ignite the spark plug 4.

At the same time, the pulse detecting circuit 33*c* detects the waveforms of the pulses for the primary coils which are shaped by the waveform shaping circuit 33*d*, and a predetermined pulse duration of the pulses is determined by the duty control circuit 33*e*. The pulse generating circuit 33*f* generates the CDI pulse in synchronism with the source VIG. The fuel injection pulse is applied to the fuel injector 11 in synchronism with the CDI pulse to start the engine 1.

The fuel injection quantity is controlled by the CPU 21 in accordance with a control program stored in the ROM 22 of the control unit 20.

In the CPU 21, the engine speed N is calculated in accordance with the period obtained by the input interval of the CDI pulses. The basic fuel injection pulse width Tp is determined based on the engine speed N and the throttle opening degree $\alpha$ from the throttle position sensor 10. The basic fuel injection pulse width Tp is corrected with the various data stored in the RAM 23 to calculate the fuel injection pulse width Ti corresponding to the fuel injection quantity. The fuel pressure PF detected by the fuel pressure sensor 50 is compared with the upper limit fuel pressure PH and the lower limit fuel pressure PL. If the fuel pressure PF is higher than the upper limit pressure PH, the pulse width Ti is corrected to reduce the fuel injection quantity. If the pressure PF is lower than the lower limit pressure PL, the pulse width Ti is corrected to increase the fuel injection quantity. A drive signal corresponding to the fuel injection quantity is applied to the fuel injector 11 through the driver 40 at a predetermined timing for injecting the fuel from the injector 11 every one rotation of the engine 1.

In order to stop the engine 1, either of the ignition switch 31 and the kill switch 32 is turned off so that off contacts of the switch close. Consequently, the voltage at the source VIG is applied to the gate of the thyristor SCR2 through the off contacts, the resister R1 and the diode D2 in the ignition source short-circuiting circuit 33*b* to render the thyristor SCR2 conductive. Thus, the source VIG is short-circuited through the resister R3 and the first diode D4, and the capacitor C2 is charged through the second diode D5.

As shown in FIG. 3*a*, since the source VIG is the intermittent voltage, the source voltage VIG reduces to a ground level, so that the thyristor SCR2 becomes off. Consequently, the capacitor C2 discharges the current which is supplied to the base of the transistor TR to turn on the transistor.

When the source voltage VIG generates again, the current is directly supplied to the gate of the thyristor SCR2 through the second diode D5, the transistor TR, the resister R5, and the diode D6. Thus, the thyristor SCR2 is turned on again to short-circuit the source VIG and to charge the capacitor C2.

This process is repeated so that a necessary energy for igniting the spark plug 4 is not applied to the primary coils of the ignition coils 4. Consequently, the voltage is reduced lower than the limit value for the ignition, thereby stopping the engine.

In the system, once turning off the kill switch 32 causes the thyristor SCR2 to turn on, the thyristor SCR2 is automatically turned on and off in accordance with the capacitor C2 and the transistor TR until the engine stops. Therefore, it is not necessary to maintain the kill switch 32 in off-state.

Figure 5:
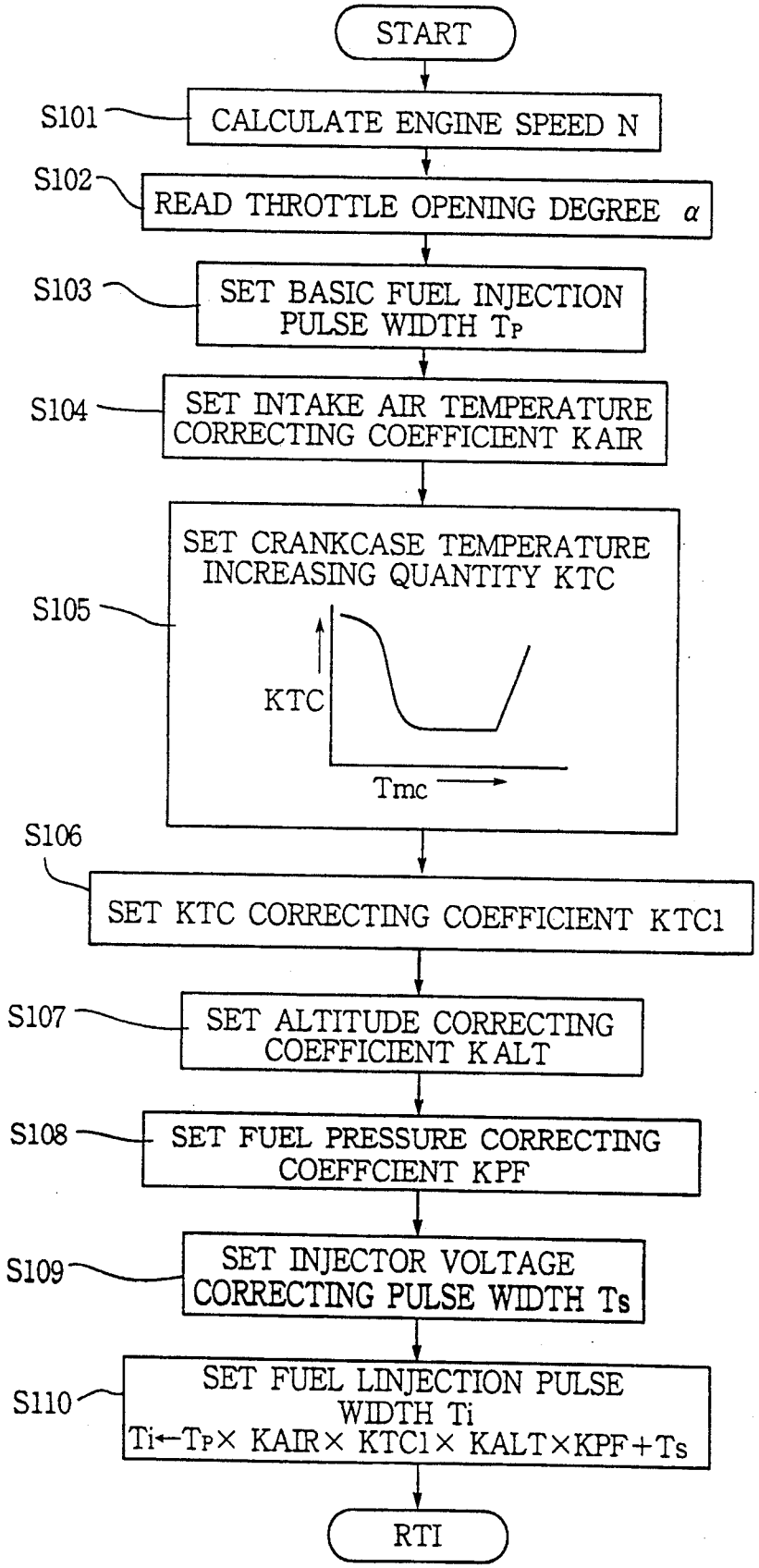
FIG. 5 is a flowchart showing an operation for determining a fuel injection pulse width.

The operation for controlling the fuel injection system in accordance with the control unit 20 is described hereinafter. First, the operation for determining the fuel injection pulse width Ti will be described with reference to the flowchart of FIG. 5. The program is repeated at every predetermined time during the power is supplied to the control unit 20.

At a step S101, a period f ($f=dT120/d\Theta 1$) is obtained in accordance with an input time interval T120 of the CDI pulse and the crank angle $\Theta 1$ ($\Theta 1=120°$; crank angle between projections 41*f* of the disk 41*e*) to calculate engine speed N ($N=60/f$). At a step S102, the throttle opening degree $\alpha$ is read from the throttle position sensor 10.

At a step S103, the basic fuel injection pulse width Tp is retrieved from a basic fuel injection pulse width look-up table MPTp in accordance with the engine speed N calculated at the step S101 and the throttle opening degree $\alpha$ read at the step S102 as parameters. The basic fuel injection pulse width Tp may be obtained directly or by interpolation in dependency on the injection pulse widths retrieved from the table MPTp.

The look-up table MPTp is provided with the basic fuel injection pulse widths Tp corresponding to the intake air quantity dependent on the throttle opening degree $\alpha$ and the engine speed N and stored in the ROM 22 as a three-dimensional look-up table. Thus, the fuel injection control having a good response to the operation of the throttle valve 9*a* is achieved.

At a step S104, an intake air temperature AIR from the intake air temperature sensor 13 is read to derived a correcting coefficient KAIR from a look-up table for correcting the density of intake air which changes in dependency on the temperature. At a step S105, a crankcase temperature TmC from the sensor 6 is read to derive a crankcase temperature increasing quantity KTC from a crankcase temperature increasing quantity look-up table MPTC. The crankcase temperature increasing quantity KTC is obtained by interpolation.

The crankcase temperature increasing quantity look-up table MPTC is provided in the ROM 22 and stores a plurality of crankcase temperature increasing quantities KTC arranged in accordance with the crankcase temperature TmC. The crankcase temperature is in a range of 20° to 80° C., the crankcase temperature increasing quantity KTC is constant. In a range lower than 20° C., the crankcase temperature increasing quantity KTC is set at a large value to improve the starting characteristic at the start of the engine, and in a range higher than 80° C., the crankcase temperature increasing quantity is increased in consideration to the intake efficiency.

At a step S106, a crankcase temperature correction coefficient KTC1 is calculated based on the crankcase temperature increasing quantity KTC in accordance with a formula $KTC1=1+KTC$. At a step S107, an altitude correction coefficient KALT is derived from a look-up table in accordance with an atmospheric pressure ALT from the sensor 36 as a parameter for correcting the intake air density which changes in dependency on the atmospheric pressure.

At a step S108, a fuel pressure correcting coefficient KPF is determined in a fuel pressure correcting coefficient set routine which will be described hereinafter. At a step S109, an injector voltage correcting pulse width Ts is obtained based on the terminal voltage VB for correcting a period of time within which fuel is not injected although the terminal voltage VB is applied to the injector. The fuel injection pulse width Ti is calculated at a step 110 in dependency on the basic fuel injection pulse width Tp obtained at the step S103, correction coefficients such as an intake air temperature correcting coefficient KAIR obtained at the step S104, a crankcase temperature increasing quantity correcting coefficient KTC1 obtained at the step S106, an altitude correcting coefficient KALT obtained at the step S107, and a fuel pressure correcting coefficient KPF obtained at the step S108 for correcting the basic fuel injection pulse width Tp, and the injector voltage correcting width Ts obtained at the step S109 to be added to the corrected pulse width Tp as follows.

$$Ti \leftarrow Tp \times KAIR \times KTC1 \times KALT \times KPF + Ts$$

The routine is terminated.

Figure 6:
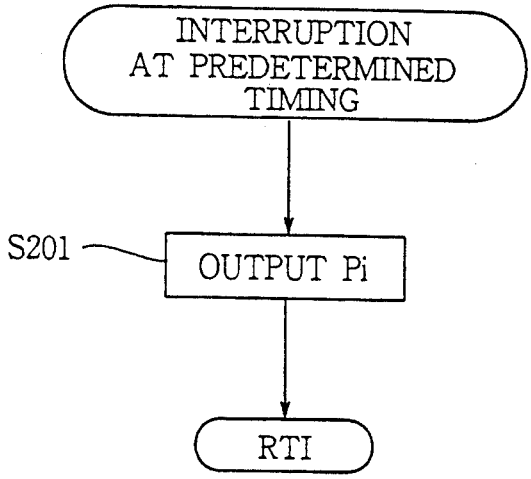
FIG. 6 is a flowchart showing an operation of a fuel injection control.

When the fuel injection pulse width Ti is determined, the operation for injecting fuel is executed as interruption at every predetermined timing in synchronism with the CDI pulse from the pulse generating circuit 33*f* as shown in the flowchart of FIG. 6. At a step 201, a drive signal in dependency on the fuel injection pulse width Ti is applied to the fuel injector 11 and the routine is terminated.

The set routine for the fuel pressure correcting coefficient KPF executed at the step S108 will be described with reference to the flowchart of FIGS. 7 and 8.

At a step S301, the fuel pressure PF from the fuel pressure sensor 50 is read. At a step S302, the fuel pressure PF is compared with a predetermined upper limit fuel pressure PH which is obtained by the experiments. The upper limit fuel pressure PH is a limit value to which the fuel pressure does not rise in an ordinary driving state. When $PF \geqq PH$, the program proceeds to a step S303. When $PF < PH$, the program proceeds to a step S304.

At the step S303, it is determined whether a high pressure correction determining flag FLAG1 is set to 1 or not. When the state of $PF \geqq PH$ is continued over a predetermined set time, it means that the fuel pressure PF is abnormally increased. In this state, the flag FLAG1 is set to 1 for determining correcting the abnormally high fuel pressure. When $FLAG1=1$, the program goes to a step S310. When $FLAG1=0$, the program proceeds to a step S305 where a count C1 of a first timer for measuring the period of $PF \geqq PH$ is incremented with 1 ($C1 \leftarrow C1+1$).

At a step S306, it is determined whether the count C1 reaches the predetermined set time CSET (for example 1.0 sec) or not. When $C1 \leqq CSET$, the program goes to a step S312. When $C1 > CSET$, it is determined that the fuel pressure is abnormally high. The program goes to a step S307 where the FLAG1 is set to 1 ($FLAG1 \leftarrow 1$). At a step S308, the count C1 is cleared ($C1 \leftarrow 0$). At a step S309, an abnormality data which represents abnormally high fuel pressure is stored in the backup RAM 24.

At the step S310, an abnormally high pressure correcting value KPFH is determined as the fuel pressure correcting coefficient KPF($KPF \leftarrow KPFH$). If the fuel pressure is abnormally increased caused by the trouble of the pressure regulator such as a close stick, the air-fuel mixture may be over-rich. The abnormally high pressure correcting value KPFH is a value obtained by experiments and determined smaller than 1.0 for preventing the air-fuel mixture from over-rich and stored in the ROM 22. Thus, the fuel injection pulse width Ti is corrected to reduce the fuel injection quantity, thereby immediately correcting the over-rich of the air-fuel mixture.

At a step S311, the ECS lamp 51 is emitted to alarm the abnormality of the fuel pressure to the driver. Thereafter, the program proceeds to the step S312.

On the other hand, at the step S304, the fuel pressure PF is compared with a lower limit fuel pressure PL which is also obtained by the experiments. When PF≦PL, the program proceeds to a step S314 of FIG. 8. When PF>PL, the program proceeds to a step S315. Since the state of PF>PL is determined at the step S304, the fuel pressure PF is in a range between upper limit fuel pressure PH and lower limit fuel pressure PL, which means that the fuel pressure PF is in a normal state. Thus, at the step S315, the fuel pressure correcting coefficient KPF is set to 1.0 (KPF←1.0). At a step S316, the count C1 is cleared (C1←0), and at a step S317, the flag FLAG1 is cleared (FLAG1←0). The program proceeds to the step S312.

Figure 8:
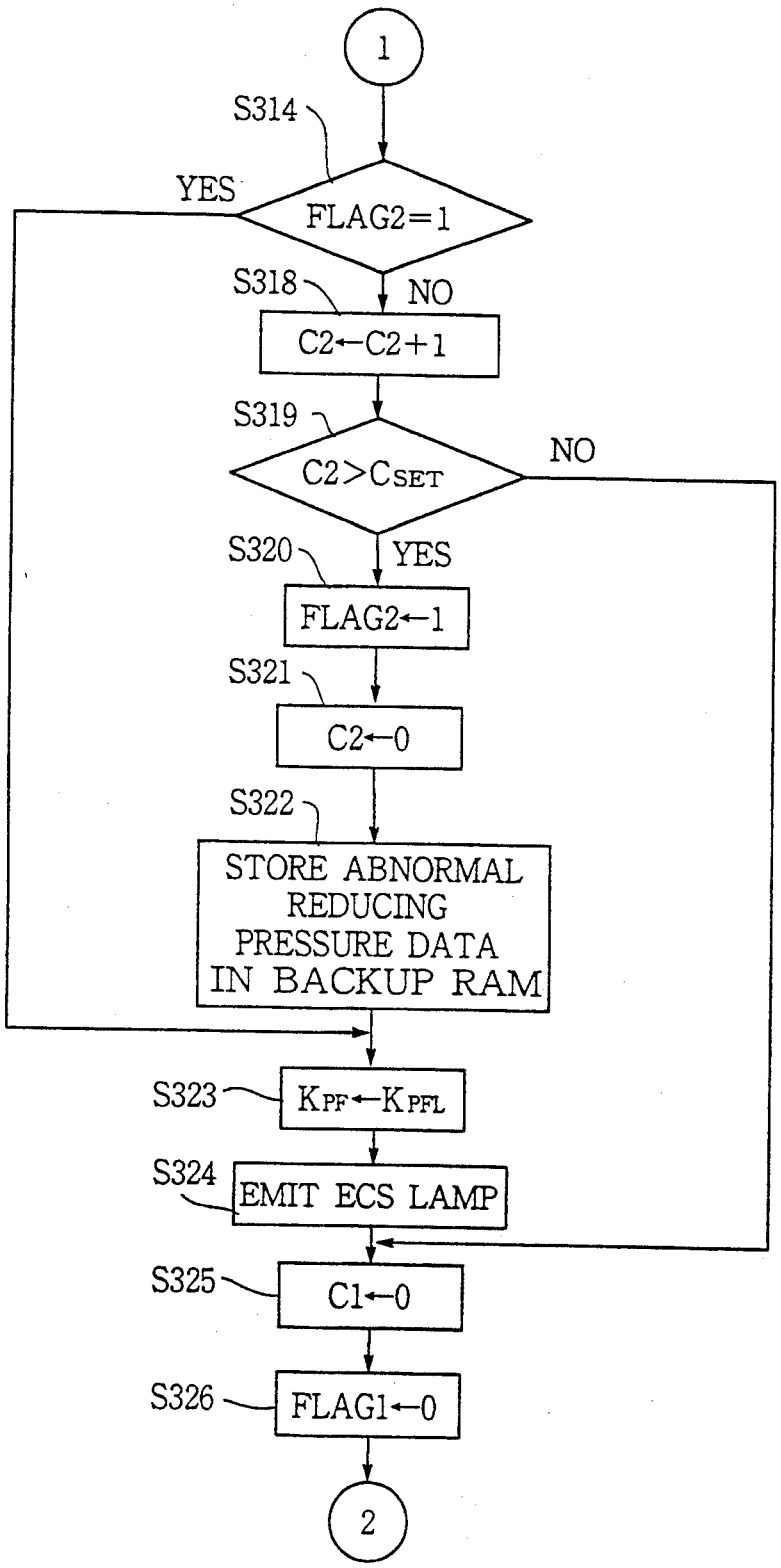

At the step S314 of FIG. 8, it is determined whether a low pressure correction determining flag FLAG2 is set to 1 or not. When the state of PF≦PL is continued over the predetermined set time, it means that the fuel pressure PF is abnormally low. In this state, the flag FLAG2 is set to 1 for determining the correction of the abnormally low fuel pressure. When FLAG2=1, the program goes to a step S323. When FLAG2=0, the program proceeds to a step S318 where a count C2 of a second timer for measuring the period of the state of PF≦PL is incremented with 1 (C2←C2+1)

At a step S319, it is determined whether the count C2 reaches the predetermined set time CSET or not. When C2≦CSET, the program goes to a step S325. When C2>CSET, it is determined that the fuel pressure is abnormally low. The program goes to a step S320 where the flag FLAG2 is set to 1 (FLAG2←1). At a step S321, the count C2 is cleared (C2←0). At a step S322, an abnormality data which represents abnormally low fuel pressure is stored in the backup RAM 24.

At the step S323, an abnormally low pressure correcting value KPFL is determined as the fuel pressure correcting coefficient KPF (KPF←KPFL). If the fuel pressure is abnormally reduced by a little residual of fuel or by the trouble of the pressure regulator 18, the air-fuel mixture may be over-lean. The abnormally low pressure correcting value KPFL is a value obtained by experiments and determined larger than 1.0 for preventing the air-fuel mixture from becoming over-lean, and stored in the ROM 22. Thus, the fuel injection pulse width Ti is corrected to increase the fuel injection quantity, thereby immediately correcting the over-lean of the air-fuel mixture.

At a step S324, the ECS lamp 51 is emitted to alarm the abnormality of the fuel pressure to the driver. Thereafter, the program proceeds to a step S325 where the count C1 of the first timer is cleared (C1←0). At a step S326, the flag FLAG1 is cleared (FLAG1←0). Furthermore, at the step S312, the count C2 is cleared (C2←0). At a step S313, the flag FLAG2 is cleared (FLAG2←0) and the program is terminated.

The trouble of the fuel pressure is diagnosed at the dealer's shop with the serial monitor 39 connected to the control unit 20 through the connector 38 by reading the data stored in the RAM 24. After repairing the troubles, the abnormally increasing or reducing pressure data stored in the RAM 24 is cleared with the serial monitor 39.

Figure 9A:
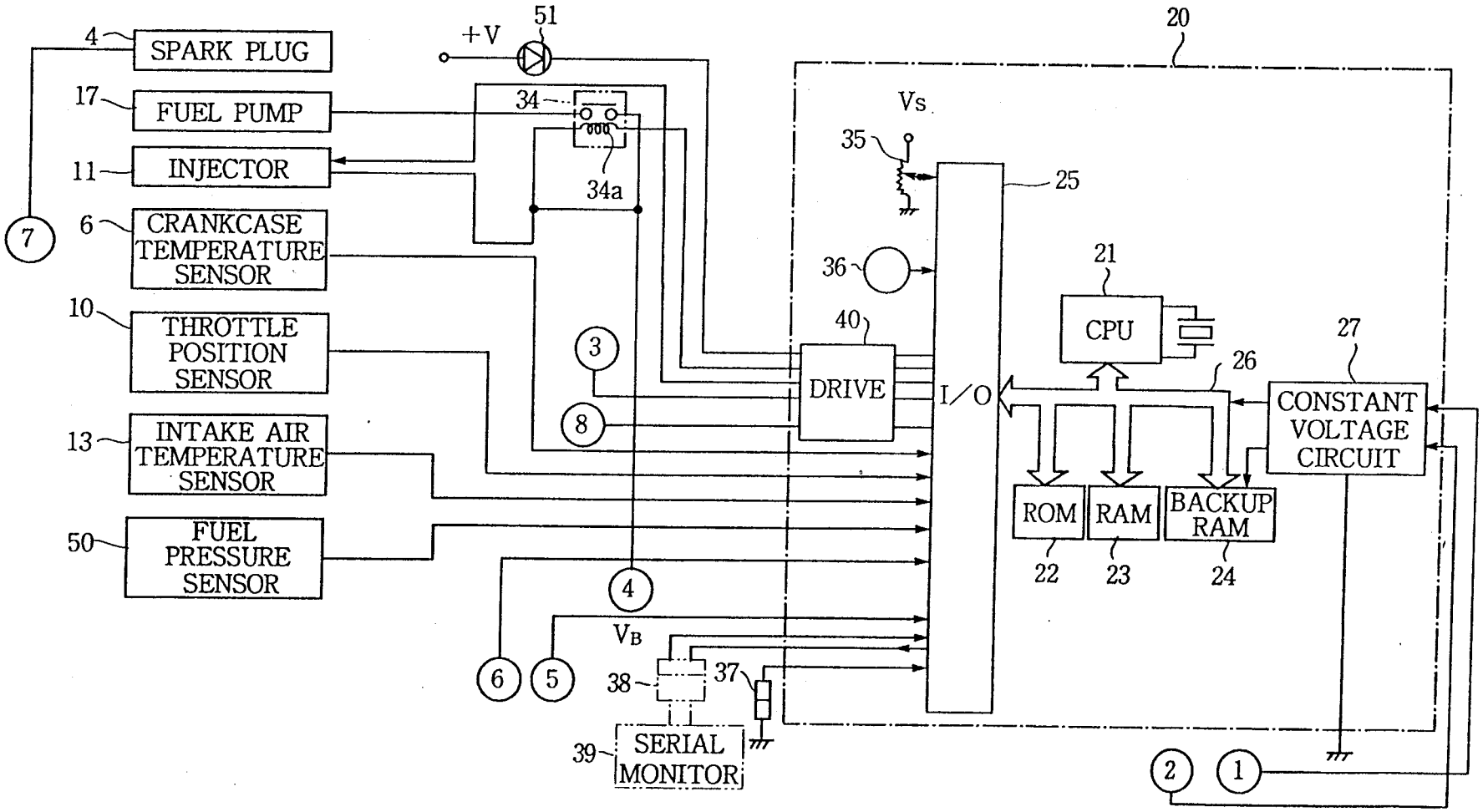
FIGS. 9*a* and 9*b* are a diagram showing the control system of a second embodiment according to the present invention.
Figure 9B:
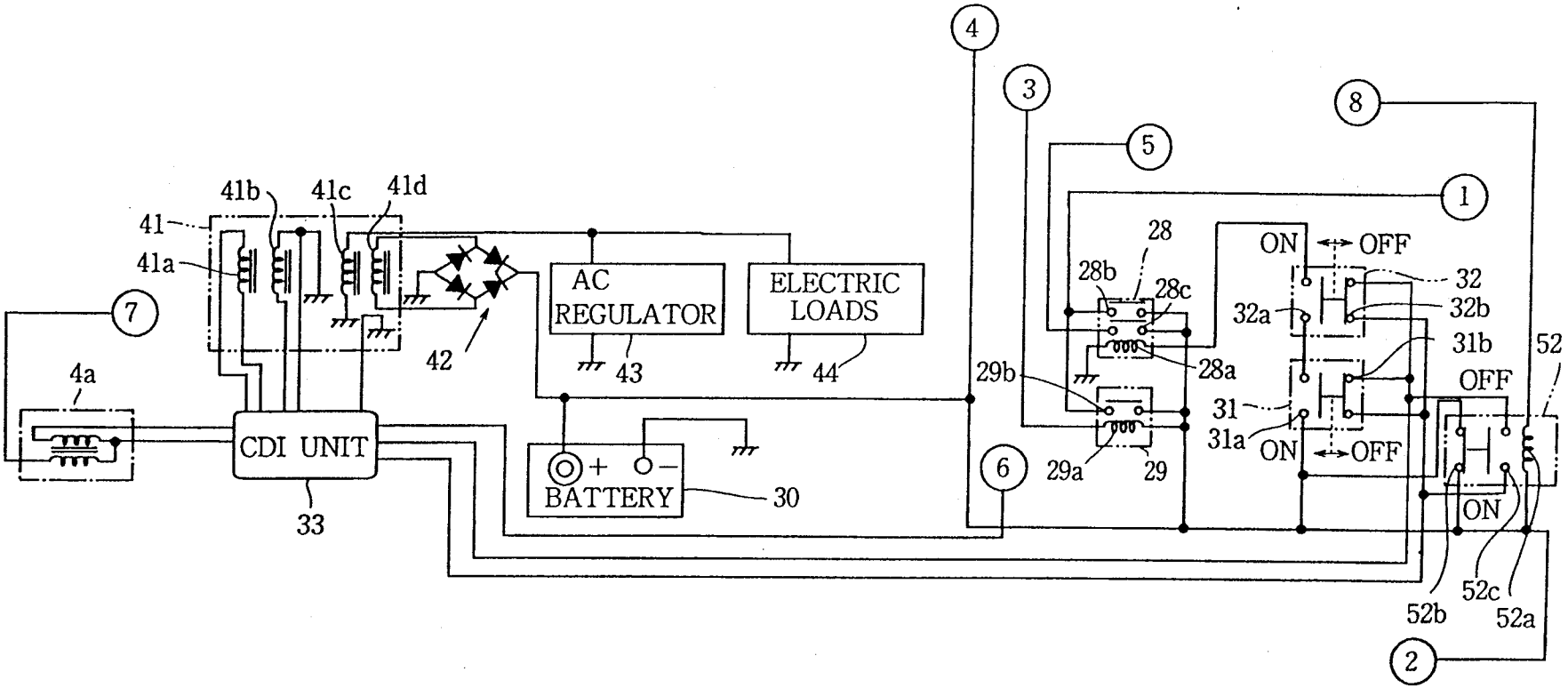
Figure 10A:
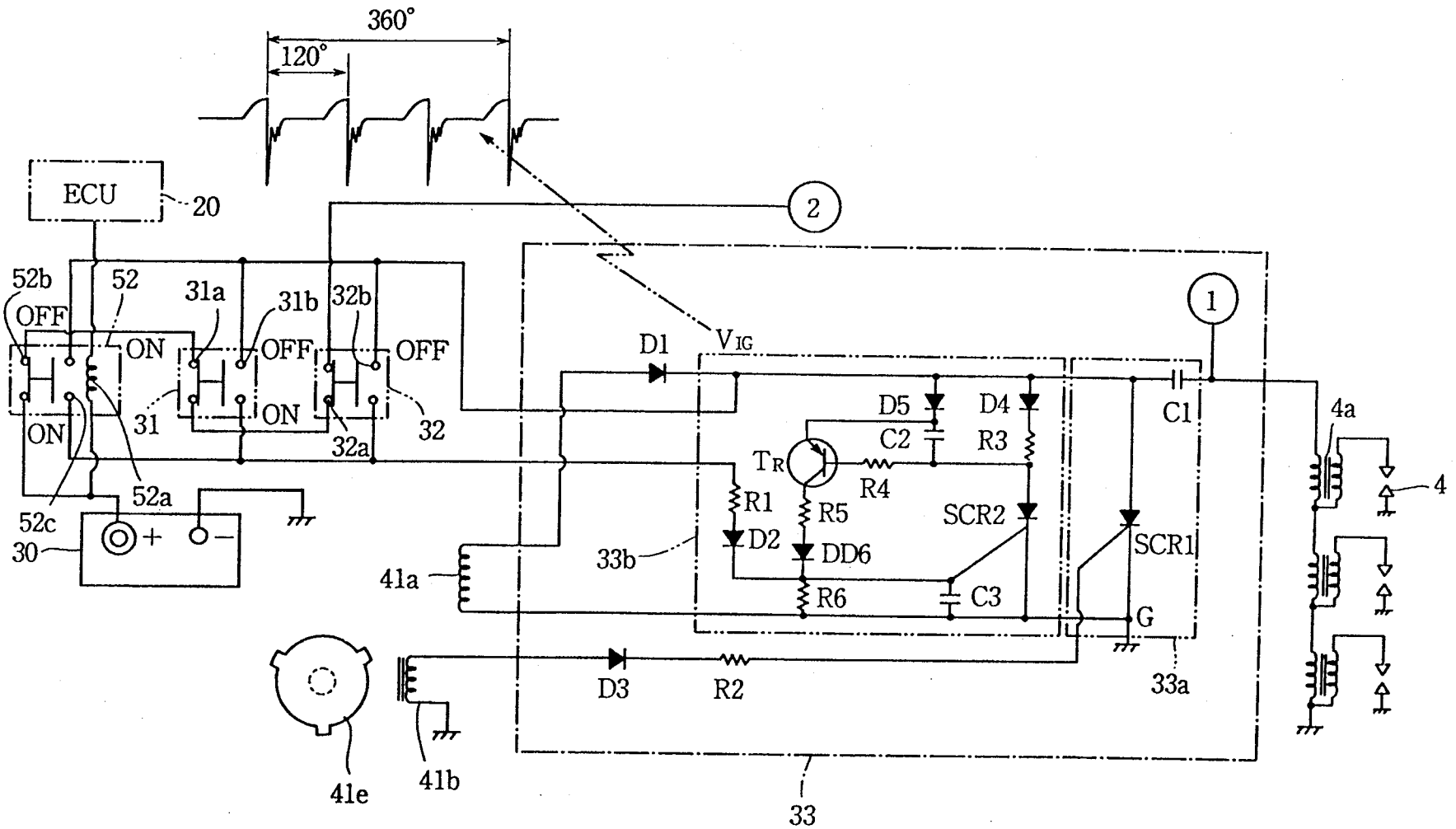
FIGS. 10*a* and 10*b* are circuits of the CDI unit of the second embodiment.
Figure 10B:
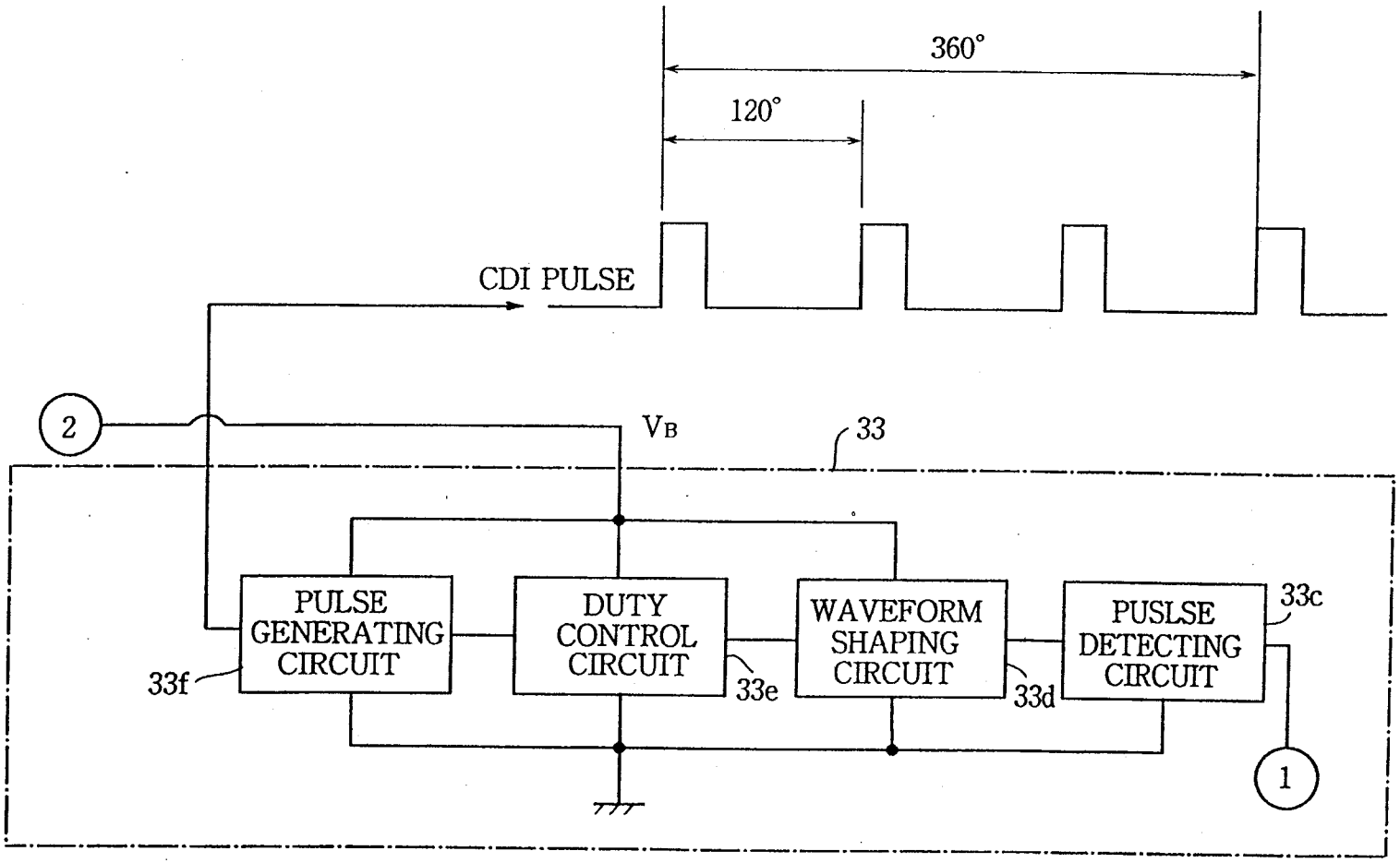
Figure 11:
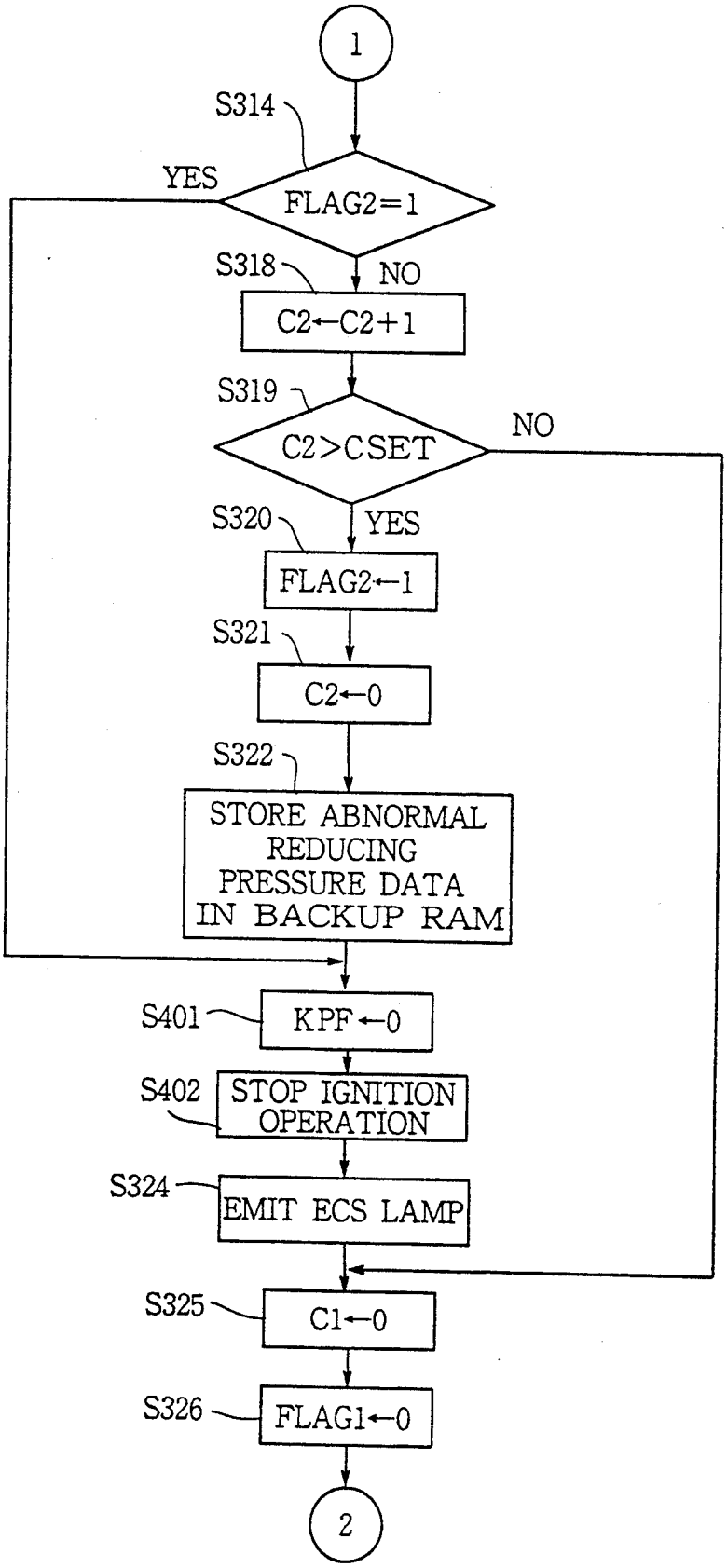
FIG. 11 is a flowchart showing the operation of the second embodiment.

FIGS. 9 to 11 show the second embodiment of the present invention. In the second embodiment, when the fuel pressure PF is lower than the lower limit pressure PL, the spark plug ignition and the fuel injection are cut off to stop the engine 1.

As shown in FIGS. 9 and 10, the control system is provided with an IG cut relay 52 connected to the ignition switch 31 and the kill switch 32 to turn off the switches. The IG cut relay 52 comprises a coil 52*a*, an ON-contacts 52*b*, and an OFF-contacts 52*c*. The coil 52*a* is connected to the battery 30 and the I/O interface 25 of the control unit 20 through the driver 40. One of the ON-contacts 52*b* is connected to the ON-contacts 31*a* and 32*a* of the switches 31 and 32 in series and the other contact is connected to the battery 30. The OFF-contacts 52*c* are connected to the OFF-contacts 31*b* and 32*b* of the switches in parallel. When the power of the battery 30 is supplied to the coil 52*a* to excite the coil, the OFF-contacts 52*c* are closed to turn off the switches 31 and 32. Thus, the source VIG of the CDI unit 33 is short-circuited to stop the ignition operation.

Figure 7:
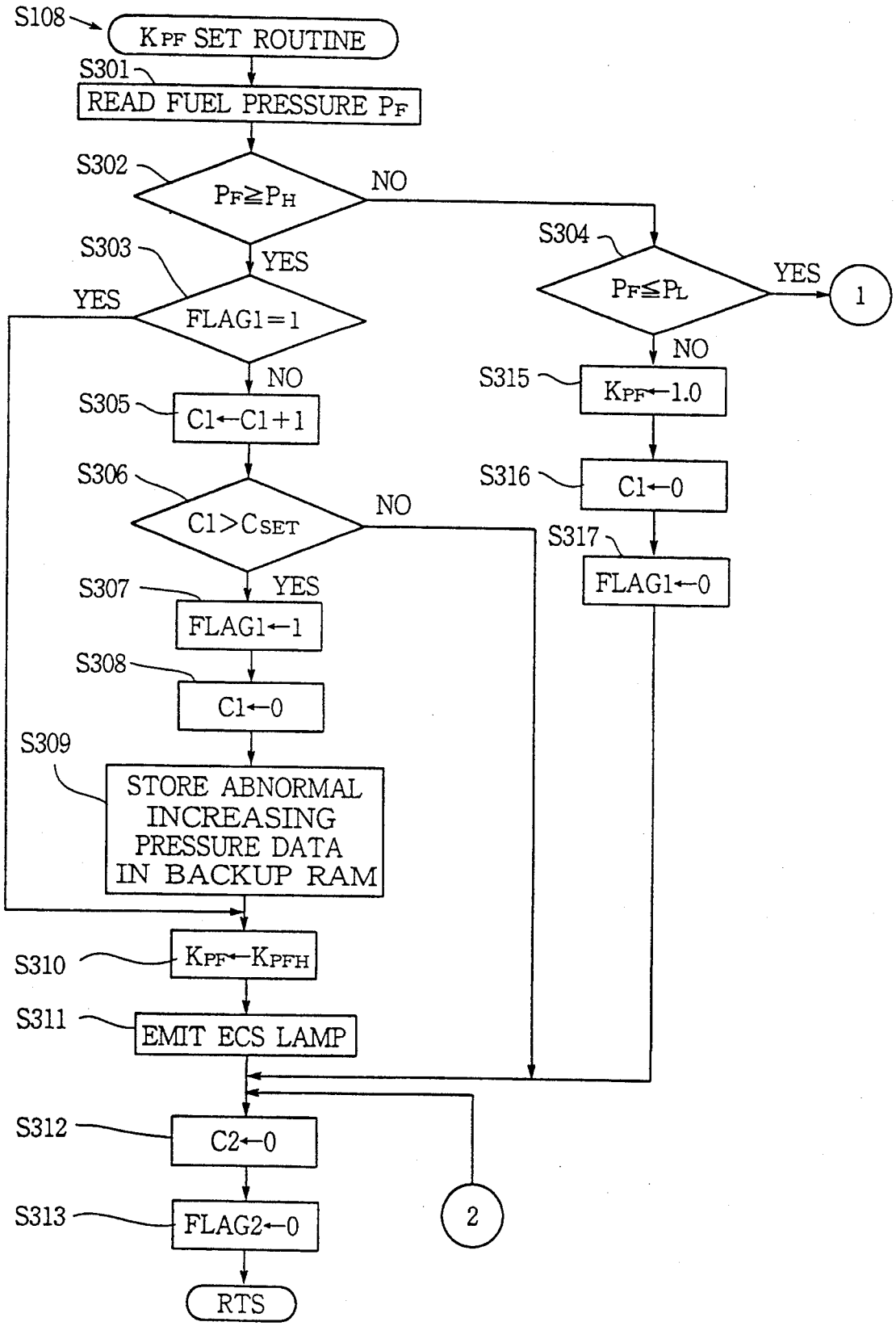
FIGS. 7 to 8 are a flowchart showing an operation for determining a fuel pressure correcting coefficient.

Describing the operation of the second embodiment, when the fuel pressure PF is abnormally increased, the pressure correcting coefficient KPF is determined in the same manner as described in the flowchart of the first embodiment shown in FIG. 7. When the pressure PF is abnormally reduced, the correcting coefficient KPF is determined in accordance with the flowchart shown in FIG. 11. The program is executed in the same manner as the first embodiment of FIG. 8 from the step S314 to the step S322.

When the abnormally low pressure data is stored in the backup RAM 24 at the step S322, the program goes to a step S401 where the fuel pressure correcting coefficient KPF is set to zero (KPF←0) to cut off the fuel. At a step S402, the coil 52*a* of the IG cut relay 52 is excited to close the OFF-contacts 52*c* thereof. Thus, the ignition operation is stopped by short-circuiting the source VIG of the CDI unit 33 as hereinbefore described.

The program proceeds to the step S324 and executed in the same manner as the first embodiment.

In the second embodiment, since the fuel injection and ignition operations are stopped, bad influence on the engine is effectively prevented.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A fuel injection control method for an internal combustion engine, having a crankshaft in a crankcase, a cylinder with a spark plug, a generator provided in said crankcase for generating power to said spark plug, an injector provided in an intake manifold for injecting an amount of fuel into said cylinder, a throttle sensor for detecting an opening degree of a throttle valve and for generating a degree signal, an atmospheric pressure sensor for sensing an atmospheric pressure, and a pressure sensor provided in a fuel supply line for detecting a fuel pressure and for generating a pressure signal, an improvement of the method which comprises the steps of:

comparing said pressure signal with a predetermined pressure value in accordance with operating conditions of said engine;

decreasing said amount of fuel when said pressure signal is higher than said predetermined pressure value; and increasing said amount of fuel when said pressure signal is lower than said predetermined pressure value.

2. A fuel injection control method for an internal combustion engine, having a crankshaft in a crankcase, a cylinder with a spark plug, a generator provided in said crankcase for generating power to said spark plug, an injector provided in an intake manifold for injecting an amount of fuel into said cylinder, a throttle sensor for detecting an opening degree of a throttle valve and for generating a degree signal, an atmospheric pressure sensor for sensing an atmospheric pressure, and a pressure sensor provided in a fuel supply line for detecting a fuel pressure and for generating a pressure signal, an improvement of the method which comprises the steps of:

comparing said pressure signal with a predetermined pressure value in accordance with operating conditions of said engine:

decreasing said amount of fuel when said pressure signal is higher than said predetermined pressure value; and stopping said engine either by cutting said power to said spark plug or by cutting said fuel when said pressure signal is lower than said predetermined pressure value.

3. A fuel injection control system for an internal combustion engine, having a crankshaft in a crankcase, a cylinder with a spark plug, a generator provided in said crankcase for generating power to said spark plug, an injector provided in an intake manifold for injecting an amount of fuel into said cylinder, a throttle sensor for detecting an opening degree of a throttle valve and for generating a degree signal, an atmospheric pressure sensor for sensing an atmospheric pressure, and a pressure sensor provided in a fuel supply line for detecting a fuel pressure and for generating a pressure signal, an improvement of the system which comprises:

comparator means for comparing said pressure signal with a predetermined pressure value in accordance with operating conditions of said engine and for producing one of pressure decreasing signal and a pressure increasing signal as a result of the comparison;

deceasing means responsive to said pressure decreasing signal for decreasing said amount of fuel; and increasing means responsive to said pressure increasing signal for increasing said amount of fuel when said pressure signal is lower than said predetermined pressure value.

4. A fuel injection control system for an internal combustion engine, having a crankshaft in a crankcase, a cylinder with a spark plug, a generator provided in said crankcase for generating power to said spark plug, an injector provided in an intake manifold for injecting an amount of fuel into said cylinder, a throttle sensor for detecting an opening degree of a throttle valve and for generating a degree signal, an atmospheric pressure sensor for sensing an atmospheric pressure, and a pressure sensor provided in a fuel supply line for detecting a fuel pressure and for generating a pressure signal, an improvement of the system which comprises:

comparator means for comparing said pressure signal with a predetermined pressure value in accordance with operating conditions of said engine and for producing a stopping signal when said pressure signal is lower than said predetermined pressure value; and stopping means responsive to said stopping signal for stopping said engine either by cutting said power to said spark plug or by cutting said fuel.

* * * * *